United States Patent [19]

Carlson

[11] Patent Number: 4,592,797

[45] Date of Patent: Jun. 3, 1986

[54] TOOL FOR FINISHING TAPED DRY WALL JOINTS

[76] Inventor: Carl Carlson, 2839 Eddington Ave., Bensalem, Pa. 19020

[21] Appl. No.: 755,475

[22] Filed: Jul. 16, 1985

[51] Int. Cl.[4] ..... B05C 17/02; B05C 17/10

[52] U.S. Cl. ..... 156/574; 15/235.4; 29/110.5; 29/125; 156/579

[58] Field of Search ..... 156/71, 574, 575, 579; 29/110.5, 125; 15/235.4

[56] References Cited

U.S. PATENT DOCUMENTS

| | | | |
|---|---|---|---|
| 2,288,987 | 7/1942 | Allen | 156/71 |
| 2,366,675 | 1/1945 | Petty | 156/575 |
| 2,815,142 | 12/1957 | Ames | 156/575 |
| 2,858,953 | 11/1958 | Harrell | 156/575 |
| 3,036,254 | 2/1962 | Keith | 118/227 |
| 3,260,638 | 7/1966 | Hoveland | 156/575 |
| 3,925,145 | 12/1975 | Ames | 156/579 |
| 3,960,643 | 6/1976 | Dargitz et al. | 156/579 |
| 4,090,914 | 5/1978 | Hauk et al. | 156/575 |
| 4,135,475 | 1/1979 | Bomers | 118/249 |

*Primary Examiner*—Michael Wityshyn

*Attorney, Agent, or Firm*—Dann, Dorfman, Herrell and Skillman

[57] ABSTRACT

A tool for finishing joints in wall board employs a generally cylindrical roller for applying pressure to imbed the tape in adhesive supported on a handle for applying pressure to the roller by a yoke rotatably supporting the roller in spaced locations along the roller axis. An adhesive trowel member is also supported on the yoke and provides an opening through which the roller projects. The trowel is positioned generally tangent to but slightly below the roller surface so that the trowel presents a curved surface of much greater radius than the roller and acts to redistribute the adhesive. A box scrapper also supported from the yoke about an axis parallel to the roller axis has a base and sidewalls, except on that side adjacent the roller. That particular side is left open to accumulate adhesive scrapped off the wall. The sidewalls are made to terminate in a common plane permitting flat contact with the wall and together act as a scrapper to collect adhesive in the box. A separate scrapper actuating means adjacent to the handle is connected to the box scrapper and enables the scrapper to be manually moved into place against the wall trailing the roller as the roller moves along a joint.

14 Claims, 4 Drawing Figures

TOOL FOR FINISHING TAPED DRY WALL JOINTS

The present invention relates to a tool for finishing dry wall employing a tape and an adhesive, such as a mastic, to cover the joint between adjacent wall boards. Specifically, the present invention relates to a tool which is capable of finishing such a joint by embedding the tape and covering it with a smooth coating of adhesive so that the joint area appears to be a smooth and flat continuation of the adjoining wall boards.

THE PRIOR ART

The prior art has provided a tool for applying tape and adhesive to a wall board joint wherein the adhesive is first layed down over the joint and the tape is applied over the adhesive and pressed in place. A tool commonly referred to in the trade as a "bazooka" applies tape and adhesive at the same time. In practice, it has been necessary for the joint tape to be wiped by hand often pressing the tape further into the adhesive and troweling the adhesive to cover the tape to smooth out the depressed surfaces at the edges of the wall board panels so that the joint appears to be a flat and even continuation of the joint wall boards. Thus, hand trowels of various types have been used in the prior art, involving a laborious, multi-step process for finishing the joint.

NATURE OF THE PRESENT INVENTION

The present invention is directed to a tool which both upgrades the quality of finish on gypsum wallboard, and also provides a new and refined dry wall procedure.

The tool of the present invention is intended for use after tape has been applied to a joint over adhesive. This tool is used to further press the tape into the adhesive and, at the same time, to move the adhesive over the top of the tape. It also functions to cover the outside of the tape with adhesive, to smooth the adhesive out and to fill in the joint depressions provided at adjacent edges of the wall board in order to give a smooth finished surface at the junction with one pass of the tool if properly manipulated.

No tool of this type has been provided in the prior art and such tools as have been used have been conventional trowels which have been used in typical manual fashion to finish the wall. Thus, the tool of the present invention is a time and labor saving device.

The tool of the present invention provides a roller, which is preferably flexible over its axial length, to apply essentially uniform pressure to press the tape into the adhesive. The roller is also supported on a pivotable yoke so that it can adjust to small changes in position or direction of pressure from the handle. The handle is preferably a pole, with the pole and the yoke preferably lying generally in the plane of the axle of the roller. The roller is surrounded at least on three sides, including the side following the roller by a convex troweling surface which tends to fold the adhesive back on top of the tape. Following the trowel is a box scraper which is open on the side adjacent the roller but which provides a wall having an edge generally in a plane tangent to the roller. The box scraper collects the extra adhesive as it is scraped by the scraper walls from the joint and allows it to be reapplied where needed as it works toward the roller in the box. The edge of box scraper on the side closest to the roller moves over the excess adhesive in order to allow the adhesive to contact the scraper walls at the far end and be collected within the box. In some preferred embodiments a pivotal plate applies outward pressure on the adhesive material collected in the box in order to assure, even when starting out, that adhesive will be applied over the tape and all gaps in the adhesive coating will be filled as the box scraper moves along the wall.

More specifically, the present invention is directed to a tool for finishing joints of wallboard comprising a roller for applying pressure to embed the tape in the adhesive. A yoke rotatably supports the roller at spaced locations along the roller axis. A handle is connected to the yoke at a position spaced from the roller surface for applying pressure to the roller when against the wall. Preferably, the handle is a pole with the pivot connection to the yoke generally perpendicular to a plane passing through the roller axis. An adhesive smoothing trowel is provided generally tangent to but slightly below the roller surface. The roller projects through an opening in the trowel. The trowel is preferably rotatably supported on a shaft supporting the roller and presents a surface curved and parallel to the axis of the roller but with a radius of curvature of much greater radius than the roller. A box scraper is pivotally supported from the yoke about an axis parallel to the roller axis and having a base and side walls except on that side adjacent to the roller which is left open to accumulate adhesive scrapped off the wall within the box scraper. The side walls terminate in a common plane permitting flat contact with the wall. A separate scraper actuating means adjacent to the handle is connected to the box scraper and enables the box scraper to be manually moved into place against the wall trailing the roller as the roller moves along the joint. Preferably, the scraper actuating means is a somewhat flexible connecting rod able to be guided along the pole by guide means fixed to the pole handle.

DESCRIPTION OF THE DRAWINGS

For a better understanding of the present invention, reference is made to the accompanying drawings in which:

Referring to FIG. 1, a tool in accordance with the present invention for finishing joints between wallboard is shown in perspective. The tool includes a roller 10 for applying pressure to tape 12 to further embed it into mastic or other adhesive 14 more of which then flows around the outside of the tape. The roller is supported on a yoke member 16 on a shaft 18. Also supported on the shaft is a curved trowel member 20 which acts to keep the mastic from rising too high above the surface of the wallboard. The yoke also provides extensions 22 from which the box scraper box 24 is supported.

Figure 4:
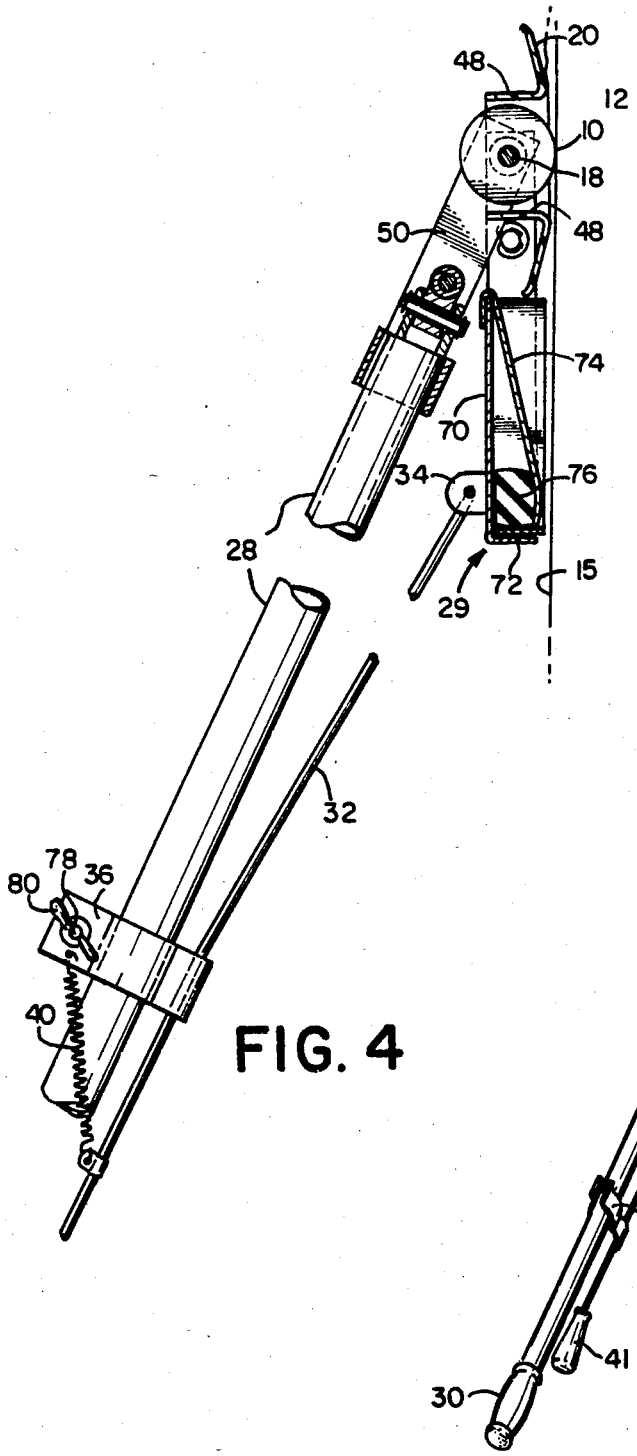
FIG. 4 is a partial sectional view taken along line 4—4 of FIG. 2.

The yoke 16 is pivotally supported by pin 26 to handle 28. Pin 26 is preferably generally perpendicular to a plane through the roller axis or shaft 18. The handle is preferably in the form of a pole sufficiently long to allow the tool to be used on wallboard joints between the bottom and the top of the wall. The pole 28 may be terminated by a hand grip 30. Paralleling pole handle 28 is a scraper actuating means 32 preferably in the form of a flexible connecting rod connected to the box scraper by a tab or bracket 34 which allows some relative rotational movement. The flexible connector is guided along the pole by guides 36 and 38 supported at spaced positions along the pole and is connected to the pole by a tension spring 40 tending to pull the connecting rod such that it urges the box scraper against the wall. A grip 41 on the flexible connecting rod enables its manual adjustment either to press it into the wall or to remove some of the pressure or withdraw it from the wall, if needed.

Figure 1:
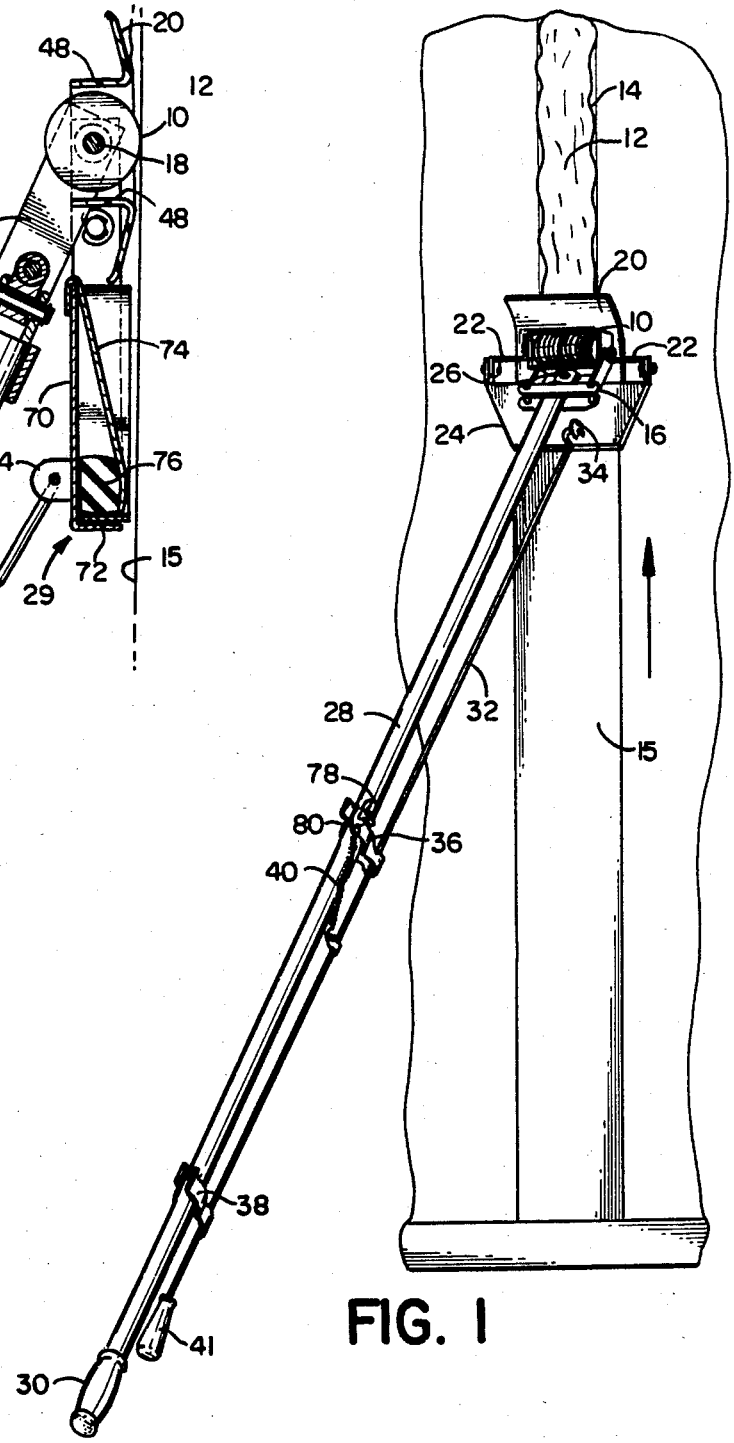
FIG. 1 is a perspective view of a tool in accordance with the present invention being used to finish a taped joint.

As seen in FIG. 1, the box scraper tends to collect the mastic and spread it out evenly over the joint providing a flat covering surface in the general plane of the wallboard.

Figure 3:
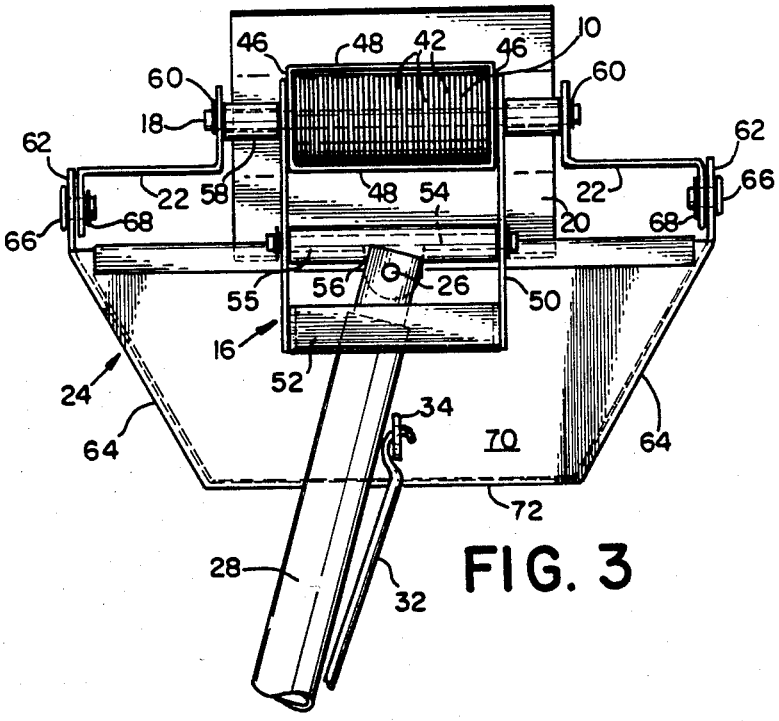
FIG. 3 is a similar enlarged view of the tool from the side viewed in FIG. 1.
Figure 2:
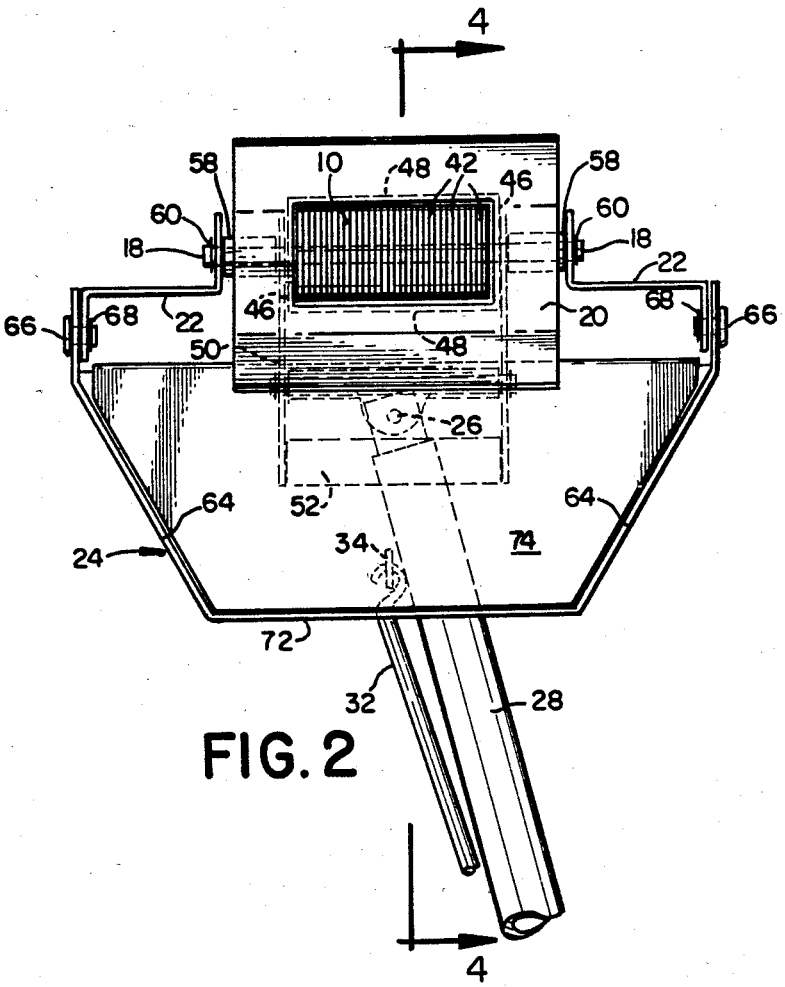
FIG. 2 is a partial enlarged view of the opposite side of the tool of FIG. 1 without adhesive being shown.

Referring now to FIG. 2 and to FIG. 3, it will be seen that the roller preferably is made up of a plurality of relatively loose fitting washer members 42 supported on the shaft 18. The washer members are preferably used to provide a somewhat yielding pressure surface. The trowel 20 is a plastic or a sheet metal member which has a curved troweling surface of such greater radius than the roller. Preferably the trowel has a hole in the middle of its troweling surface. The trowel also is provided with flanges 46, 48 surrounding the opening, and the flanges 46 embracing the ends of the roller may provide bearings to rotatably support the trowel on the shaft 18. The arrangement is such that, in addition to these support flanges 46, there are longitudinal flanges 48, which together form a sort of rectangular box around and closely confining the roller.

Outside of the flanges are parallel arms 50 of the yoke 16 which support shaft 18 and which are connected together by a pair of spaced cross bars 52 permitting passage of pole handle 28, and by connection member 55. Connection member 55 is a tubular member rotatably supported on rod 54 which provides a flat tab 56 through which passes the pivot connection 26. That pivot connection 26 may be a suitable bolt and nut type fastener. Pivot connection 26 is normal to a plane through the yoke and the pole 18 of the roller and provides for lateral movement of the pole relative to the yoke allowing the operator to position the device and steer it somewhat.

Outside of the yoke members 50 on shaft 18 are a pair of spacer tubes 58 which space the bracket members 22 from the yoke. The whole assembly may be held together by snap rings 60 placed in circumferential grooves in shaft 18 outside of each bracket member.

The scraper box is generally designated 24. The support brackets 22 for the box may be arranged to be pivotable about shaft 18. Additionally, the other end of the brackets 22 are fixed to the extension arms 62 of the side walls of the box by fasteners 66 of screw-like form but the shank of which is preferably not threaded to provide a shaft permitting relative rotation between the brackets 22 and the support arm 62. As shown, the head of the fasteners 66 stops against the support arm 62. A snap ring 68 designed to fit into a groove on the shank of the fastener 66 holds the rotatable pieces in place relative to one another laterally and yet permits their relative rotation. The brackets 22 are here shown as having three portions, parallel end mounting portions and an intermediate extension portion which provides whatever spacing is considered desirable.

The box scraper 24 is best seen in FIG. 4 as consisting of a base 70 and an end wall 72 as well as the side walls 64. The end and side walls are continuous and illustrated as perpendicular to the base for convenience, and their height is governed by the function they perform in scraping off the excess adhesive to permit its reapplication to the top of the tape. The top or scraping edge of the walls are preferably approximately in the plane of the roller surface when the device is in operation. As best seen in FIG. 4, the box scraper is preferably provided with a rotatably supported adhesive collector plate which is formed to conform with the base of the box scraper within the side and end walls of the that structure. In the form shown the adhesive collector plate 74 is provided with a U-shaped bend which fits over the base at the open end thus allowing the collector plate to rotate about the edge of the base 70. The collector plate here is formed with a hairpin bend with narrow wall **74*a* engaging the other side formed as a stop so as to limit the rotation of the collector plate 74. Other stop means can be employed in general to limit rotation from flat against the base to the extended position of FIG. 4. The collector plate is adhesively secured to a highly and easily compressible mass of resilient material 76, such as rubber, which forms both a seal and a positioning member and allows the collector plate to move down in the scraper box as the adhesive is collected within it. At the same time the pressure of the resilient member 76** urges the collector plate outwardly so as to continually press the mastic into the wall and to assure that voids or pockets of the adhesive are filled in and a smooth coating is provided. This feature eliminates the possible need for touchup that might otherwise exist were the collector plate not provided.

Also seen in FIG. 4, the flange 34 may be formed by lancing out a portion of the base 70 and bending it outward to a position generally normal to the base. This allows a portion of the flexible connecting rod 32 bent as a rotational pin connection to be inserted through a hole in the flange 34 so that it lies generally parallel to axis 18 of the roller and allows relative rotational movement between the flexible connecting rod 32 and the box scraper. The guides 36 and 38 are sheet metal members formed into guide loops and then clamped to surround the pole 28 to thereby confine and guide the flexible member 32 close to the pole. If desired, the clamps may be held in place by an easily removed screw and wing nut connection 78, 80. One end of the spring 40, which is preferably a coil tension spring, may be provided with a loop to engage the bolt 80. The other end may have a termination which can be passed through a hole in the flexible connecting rod.

In operation, the use of the tool of the present invention follows the use of a tool which applies mastic and tape over the joint. The tool of the present invention then is brought into use. As indicated in FIG. 1, it starts at the bottom of the wall adjacent the floor with the roller pressing the tape into position. As soon as the scraper can be moved flat against the wall, that is done and it immediately begins to collect and redistribute the extra adhesive 14 within the box. The resilience of member 76 allows the collector plate 74 to depress as adhesive is collected but also permits immediately allowing a thin layer of adhesive to be spread over the top of the collector plate available for use in filling in areas where more mastic is needed and thus provide the smooth coating 15 as shown in FIG. 1. Usually this coating is applied within a shallow channel at the edges of the wallboard which are somewhat thinned in order to provide such a channel to facilitate completing the taping and the finishing in this manner so that neither the tape nor the joint will be seen.

As the tool moves upward against the wallboard as seen in FIG. 1, pressure is maintained on the roller through handle 28. The device is steered somewhat by moving the handle from side to side. Also, pressure on the tape may be somewhat redistributed in that way.

The use of the floating washers 44 as a resilient roller allows pressure to be applied somewhat differentially in order to allow high places of the tape to be pressed into position. Meantime, the adhesive along the edges squeezed out from behind the tape is smoothed down somewhat by the trowel member 20 and then collected within the box scraper and redistributed in the final surface 15. Usually a single pass along the entire length of the joint is all that is necessary for a fast efficient job to be performed, and considerable hand work and finishing is eliminated by use of the tool.

It will be appreciated by those skilled in the art that the accompanying drawings and description describe a preferred embodiment. Many variations can be made in the structure in accordance with the present invention and all such variations are within the scope of the claims and are intending to be within the scope and spirit of the present invention.

I claim:

1. A tool for finishing joints in wallboard comprising:

a generally cylindrical roller for applying pressure to tape to embed it in adhesive;

a yoke rotatably supporting the roller at spaced locations along the roller axis;

a handle connected to the yoke for applying pressure to the roller when against a wall;

an adhesive trowel member for redistributing adhesive having an opening through which the roller projects and positioned generally tangent to but slightly below the roller surface, the trowel member presenting a curved surface of much greater radius than the roller;

a box scraper rotatably supported from the yoke about an axis parallel to the roller axis having a base and sidewalls except on the side adjacent the roller which is left open to accumulate adhesive scraped off the wall, said side walls terminating in a common plane permitting flat contact with the wall and act as a scraper to collect adhesive in the box; and a separate scraper actuating means adjacent the handle connected to the box scraper and enabling the box scraper to be manually moved into place against a wall trailing the roller as the roller moves along a joint.

2. The tool for finishing joints of claim 1 in which the handle is pivotally connected to the yoke to rotate about an axis generally perpendicular to a plane including the roller axis.

3. The tool for finishing joints in accordance with claim 2 in which the handle is a pole allowing the tool to reach higher positions than it might otherwise reach.

4. The tool for finishing joints in accordance with claim 3 in which the scraper actuating means is a flexible connecting rod positioned adjacent the pole handle and confined to this position by guides affixed to the pole which aid in directing and handling the connecting rod.

5. The tool for finishing joints in accordance with claim 4 in which the flexible connecting rod is also spring connected to the handle in such a way as to urge the box scraper into the wall and the end of the connecting rod may be manipulated to relieve the spring pressure as well as to apply additional pressure as needed.

6. The tool for finishing joints in accordance with claim 1 in which the roller rotates about a shaft on the roller axis and the shaft is supported by the yoke.

7. The tool for finishing joints in accordance with claim 6 in which the roller is made up of a plurality of washers side by side placed together over the shaft.

8. The tool for finishing joints in accordance with claim 6 in which the roller is somewhat yielding over its length so as to accommodate irregularities in the tape application and irregularities in the wallboard.

9. The tool for finishing joints in accordance with claim 1 in which the adhesive smoothing trowel is a sheet metal member having an opening for the roller and having flanges at that opening close spaced to at least one side and both end of the roller and rotatably supported on the roller shaft by bearings in the flanges.

10. The tool for finishing joints in accordance with claim 9 in which the opening in the trowel completely and closely surrounds the roller and flanges are provided along both sides and at both ends of the roller.

11. The tool for finishing joints in accordance with claim 1 in which the box scraper is supported on extensions of the yoke beyond the trowel edges enabling the box scraper to be supported and spaced beyond the trailing edge of the trowel away from the roller and to maintain a pivotal axis which is parallel and close to the roller axis.

12. The tool for finishing joints in accordance with claim 11 in which the box scraper walls converge in the direction away from roller and are positioned so that the tops of the walls remote from the base are supported to lie generally tangent with the roller.

13. The tool for finishing joints in accordance with claim 12 in which the side walls of the box scraper include a back wall essentially parallel to the axis of the roller and edge walls which converge toward and are joined with the back wall.

14. The tool for finishing joints in accordance with claim 13 in which the box scraper contains a rotatably supported adhesive collector plate generally conforming in shape to the base of the box scraper from which the collector plate is rotatably supported adjacent that edge closest to the roller and resilient means is provided between collector plate and the base urging them rotatably apart, and stop means is provided limiting the rotation of the collector plate away from the base, whereby accumulation of adhesive material within the box scraper will cause the resilient means to yield allowing the collector plate to rotate closer to the base while maintaining pressure urging collected adhesive back into the joint.

* * * * *